United States Patent [19]

Wenger

[11] 4,346,464

[45] Aug. 24, 1982

[54] CONTROL MEMBER FOR A WATER-TIGHT WATCH

[75] Inventor: Karl Wenger, Chambesy, Switzerland

[73] Assignee: Boninchi S.A., Geneva, Switzerland

[21] Appl. No.: 165,265

[22] Filed: Jul. 2, 1980

[30] Foreign Application Priority Data

Jul. 4, 1979 [CH] Switzerland ..... 6226/79

[51] Int. Cl.[3] ..... G04B 37/00

[52] U.S. Cl. ..... 368/289; 368/308; 368/319

[58] Field of Search ..... 368/288–292, 368/319–321, 308

[56] References Cited

U.S. PATENT DOCUMENTS

| | | | |
|---|---|---|---|
| 2,773,347 | 12/1956 | Froidevaux | 368/288 |
| 3,164,954 | 1/1965 | Soguel | 368/288 |
| 3,178,879 | 4/1965 | Nardin | 368/288 |
| 3,362,153 | 1/1968 | Wenger | 368/290 |
| 3,757,512 | 9/1973 | Zellweger | 368/290 |
| 3,977,178 | 8/1976 | Wenger | 368/290 |

FOREIGN PATENT DOCUMENTS

| | | | |
|---|---|---|---|
| 2235414 | 1/1975 | France . | |
| 1364504 | 3/1982 | France | 368/288 |
| 233224 | 10/1944 | Switzerland | 368/288 |
| 367857 | 5/1964 | Switzerland | 368/288 |
| 581340 | 10/1976 | Switzerland . | |

*Primary Examiner*—Bernard Roskoski

*Attorney, Agent, or Firm*—Robert E. Burns; Emmanuel J. Lobato; Bruce L. Adams

[57] ABSTRACT

A control member such as a push button or winder for a thin water-tight watch has a tube fitted to the watch case, and a control rod movable in the tube by a manually movable head fixed to the rod. Surrounding the tube axis is a sealing O-ring making sealing contact with and around a surface of the tube. The ring compressed axially of the tube is disposed between the head and tube in a housing defined in part by first and second faces on the head. The first face is annular in a plane at right-angles to the tube axis and the second face is cylindrical centered on the tube axis and spaced radially of the tube from the ring.

7 Claims, 2 Drawing Figures

CONTROL MEMBER FOR A WATER-TIGHT WATCH

FIELD OF INVENTION

This invention relates to a control member for a water-tight watch.

The control member is of a type comprising a head integral with a control rod and mounted on or in a tube intended to be fixed to a watch case, and an annular packing disposed between the head and the wall of the tube.

BACKGROUND OF INVENTION

Numerous constructions of control members of the above described type are known, whether the latter relate to a push rod, corrector or winder. It is common to all these constructions that the annular packing, generally constituted by an O-ring seal, is compressed radially between the tube and the centre of the head (see for example Swiss Pat. No. 581 340) or between the tube and an auxiliary ring (see French Pat. No. 2 235 414). Hitherto, such an arrangement has always seemed necessary for ensuring the seal between the head and the tube.

The introduction of increasingly thinner watches has caused the problem of manufacturing control members, in particular push rods or correctors which can be fitted on very shallow cases. The problem particularly occurs of manufacturing a push rod having a tube whereof the diameter is less than 2 mm and more precisely a diameter of 1.70 mm. On constructing a push rod according to the prior art, which satisfied the standards relating to water-tightness, it was found that the push rod was unusable owing to the frictional forces of the packing, which frictional forces become equal to or greater than the force of a return spring. The use of a more powerful spring which was theoretically possible, although giving rise to another problem in view of the extremely small space for housing the latter and thus limiting the diameter of the wire of the spring to a dimension of the order of 0.15 mm, proves in practice to be a useless solution for two reasons. The first is the danger of separation of the head from the control rod by spring pressure, the head and control rod usually being force fitted together. The second is the excessive difficulty the user experiences in view of the very small surface area of the head and the painful pressure exerted on the user's finger when the user attempts to actuate the push rod by pressing on the head. Admittedly, lubrication of the packing is able to reduce the friction, but only constitutes a palliative whereof the effect lasts for a short duration. Finally, it has been proved that it is virtually impossible to force fit known control members of the aforesaid type into the watch case without this resulting in a certain buckling, i.e. misalignment of the head and the rod with respect to the tube. The consequence of this misalignment may be the separation of the packing from the head or tube, the effect of which is to reduce or even destroy the effectiveness of the seal when the packing is exclusively compressed radially between the tube and head. This drawback could be eliminated by increasing the compression of the packing, but the effect of this measure is to further increase the frictional forces. In French Pat. No. 2 235 414, it was proposed to remedy this drawback by fitting the annular packing between the tube and a cylindrical ring which was free radially in the head, the packing being compressed radially between the tube and the ring. However, this solution requires an additional part and considerable hollowing-out of the head and its fitting is delicate.

SUMMARY OF THE INVENTION

An object of the invention is to provide a simple solution to the aforedescribed problem by providing a water-tight control member which can be constructed to very small dimensions and is therefore particularly suited for extra flat watches.

According to the invention there is provided a control member for a water-tight watch, comprising a head integral with a control rod and mounted on or in a tube for fixing to a watch case, an annular packing disposed between the head and the wall of the tube, the annular packing being compressed axially on both sides, and said packing being fitted with radial clearance between the packing and the head so that the head is able to move radially relative to the tube without causing deformation of the packing.

This control member has made it possible to achieve the aforesaid object in an unexpected manner.

Contrary to what one would have expected, the radial clearance of the packing does not substantially reduce the water-tightness, it has been possible to maintain sealing effects up to pressures of 20 atmospheres.

When the control member is in the form of a push rod it may be actuated normally without excessive pressure, and the return spring fulfils its function perfectly.

As a corollary, the radial clearance also provides another important advantage. This is that misalignment is tolerable if it is less than the clearance, so that it is not necessary to have very strict tolerances for a housing recesses containing the packing, the packing itself and for the assembly forming the push rod as a whole. Manufacturing cost can be reduced and assembly of the push rod is facilitated.

In fact, the packing is no longer compressed radially, since the clearance allows it to move freely radially, so that the pressure which it exerts on the tube no longer depends on the compression force of the packing, which depends on its dimensions, but solely on the material forming the packing. It is thus possible to allow greater tolerances as regards the dimensions of the packing.

These advantages also apply to a control member in the form of a winder or button rim which of necessity must be able to rotate and slide.

BRIEF DESCRIPTION OF DRAWINGS

The invention will now be further described, by way of example, with reference to the accompanying drawings in which.

DESCRIPTION OF PREFERRED EMBODIMENTS

Figure 1:
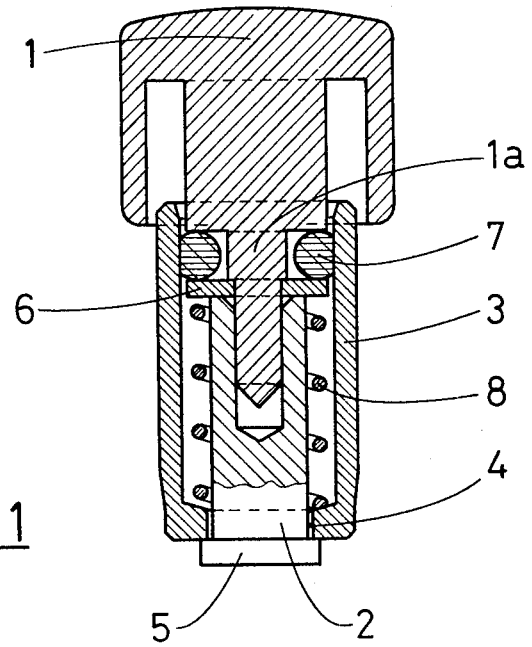
FIG. 1 is an axial sectional view of a push rod formed according to the invention.

The push rod illustrated in FIG. 1 comprises a head 1 force fitted in a rod 2 in a tube 3 intended to be force fitted in a side of a watch case. The completely assembled push rod is driven into the case by striking the head 1. The rod 2 passes through the tube 3 through an end hole 4 and has a boss 5 which bears against an end of the tube. At its other end, the rod 2 bears against a washer 6 and holds the washer against a boss on the head. With another boss on the head 1, the washer 6 forms a housing for an annular packing 7 of the O-ring seal type. When assembled, the inner diameter of the annular packing 7 is greater than the diameter of a central part 1*a* of the head surrounded by the packing in order to leave a radial clearance. On the other hand, the packing 7 is compressed axially between the head and the washer 6. Mounted inside the tube 3 is a helical spring 8 which is under compression between the bottom of the tube 3 and the washer 6 and keeps the boss 5 on the rod in abutment with the end of the tube 3. With the exception of the packing, all the parts are made of metal. Since the packing 7 is able to move radially before assembly, it is preferable to lubricate the packing in order to facilitate its automatic centering at the time of assembly of the push rod.

For example dimensions of the push rod may be as follows:

| | |
|---|---|
| diameter of the head: | 2.30 mm |
| outer diameter of the tube: | 1.70 mm |
| diameter of the wire constituting the spring: | 0.15 mm |
| radial clearance of the O-ring seal: | 0.1 to 0.2 mm |

It should also be noted that the hole 4 at the end of the tube may be smaller than in previously known constructions of push rod. This decrease in the size of the hole facilitates manufacture, and is possible because the hole no longer has to allow for misalignment of components during assembly of the push rod in FIG. 1, the effect of such misalignment being accommodated by the radial clearance at the packing.

In a modification which is not illustrated, the housing for the packing 7 may be constituted by a groove obtained by hollowing-out the part 1*a* of the head, which makes it possible to dispense with the washer 6.

The same construction can be used for a screwed corrector, in this case the tube comprises a screw thread and a splined part providing engagement for a screwing tool. In this case, the head stops in the vicinity of the tube.

Figure 2:
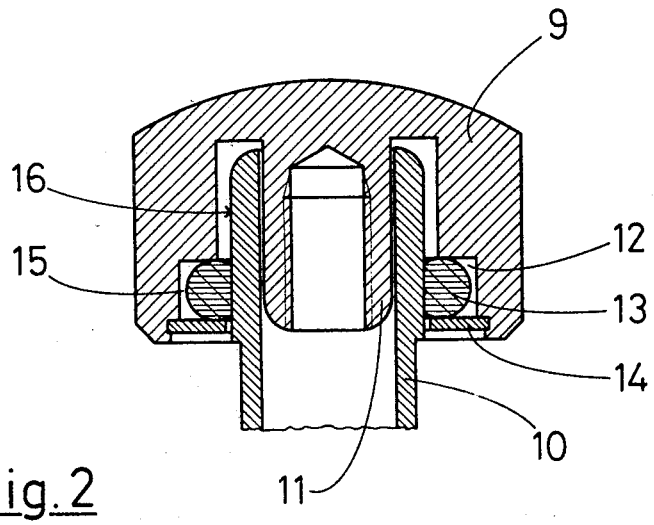
FIG. 2 is an axial sectional view of a winder formed according to the invention.

FIG. 2 illustrates a winder dome 9 which constitutes the head fitted on a tube 10. A centre part 11 of the dome 9 has an internal screw thread to engage a winder rod (not shown). The dome 9 comprises a recess 12 in which an O-ring seal 13 is disposed. This seal is held by a washer 14 fixed in the dome. The O-ring seal 13 is fitted with radial clearance 15 in the dome and surrounds the tube 10 thus deforming the O-ring elastically. The O-ring 13 compressed axially between the washer and the bottom of the recess 12, which compression ensures a fluid tight sealing effect. Outer surface 16 of the tube is smooth to facilitate rotation and sliding of the O-ring seal 13 on the tube.

The outer diameter of the tube part having surface 16 is, for example, 2.00 mm.

What is claimed is:

1. A control assembly for a water-tight watch of small dimensions having a case, comprising:

a tube adapted to be fixed water-tight to the case of a watch and to extend outwardly from said case, a control member having a head portion and a stem portion freely received in said tube for movement of said control member relative to said tube, means defining an annular recess in said stem portion opening toward the inside of said tube and having a bottom wall and parallel axially spaced radial side walls lying in planes perpendicular to said tube, and a resilient annular packing in said recess, said packing being compressed in an axial direction between said parallel radial side walls of said recess, engaging an inner surface of said tube and having a free side spaced with a radial clearance from said bottom wall of said recess.

2. A control assembly according to claim 1, in which said stem portion comprises a rod having an axial bore, said head portion having an integral pin force-fitted in said axial bore of said rod.

3. A control assembly according to claim 2, in which said annular recess is defined by an annular surface of said head portion and a washer clamped between an end of said rod and a shoulder on said pin.

4. A control assembly according to claim 1, in which said control member is a push member movable axially relative to said tube, and in which a return spring surrounding said stem portion acts between said head portion and an inturned inner end of said tube.

5. A control assembly according to claim 4, in which said spring is formed of wire having a diameter not exceeding 0.15 mm.

6. A control assembly according to claim 1, in which said radial clearance is at least 0.1 mm.

7. A control member according to claim 1, in which said annular packing is an O-ring.

* * * * *